United States Patent [19]

Haverick et al.

[11] Patent Number: 4,934,877

[45] Date of Patent: Jun. 19, 1990

[54] PNEUMATIC GATE FOR RAILWAY HOPPER CARS

[75] Inventors: Wallace F. Haverick, River Edge; Daniel J. Tearpock, Iselin, both of N.J.

[73] Assignee: Ellcon-National, Inc., Totowa, N.J.

[21] Appl. No.: 307,295

[22] Filed: Feb. 6, 1989

[51] Int. Cl.[5] ..... B65G 53/46

[52] U.S. Cl. ..... 406/128; 220/314; 406/131; 406/137; 406/145

[58] Field of Search ..... 406/117, 118, 127, 128, 406/130, 131, 134, 136, 137, 138, 145, 154; 222/195; 105/247, 358; 138/89; 220/314; 137/843, 852, 855, 860

[56] References Cited

U.S. PATENT DOCUMENTS

| | | | |
|---|---|---|---|
| 3,583,768 | 6/1971 | Koranda | 302/52 |
| 3,693,839 | 9/1972 | Shaver et al. | 406/138 X |
| 3,708,209 | 1/1973 | Dugge | 302/52 |
| 3,929,261 | 12/1975 | Sollmar . | |
| 3,952,956 | 4/1976 | Steele | 239/602 |
| 3,989,310 | 11/1976 | Aller . | |
| 4,030,755 | 6/1977 | Heimke . | |
| 4,036,532 | 7/1977 | Waddell et al. . | |
| 4,057,155 | 11/1977 | Deeks . | |
| 4,082,365 | 4/1978 | Dugge et al. . | |
| 4,151,935 | 5/1979 | Dugge . | |
| 4,172,539 | 10/1979 | Botkin . | |
| 4,189,263 | 2/1980 | Krug Jr. et al. . | |
| 4,466,558 | 8/1984 | Dugge et al. . | |
| 4,500,230 | 2/1985 | Bateson | 406/131 |
| 4,556,173 | 12/1985 | Pausch et al. . | |
| 4,662,543 | 5/1987 | Solimar | 222/195 |
| 4,695,207 | 9/1987 | Miller | 406/145 X |
| 4,739,964 | 4/1988 | Hutt . | |

*Primary Examiner*—Sherman D. Basinger
*Attorney, Agent, or Firm*—Brooks Haidt Haffner & Delahunty

[57] ABSTRACT

A gate for attachment to the hopper of a railway car or other vehicle which carries particulate material. The gate has a pair of sloping walls with facing surfaces, and the lower ends of the walls are spaced apart to permit the particulate material to be discharged into a trough below the spaced ends from which the particulate material is removed by a vacuum hose. A pair of separately operable, rotatable valves of arcuate cross-section are disposed at the space between the ends of the walls to block or permit particulate material flow into the trough. Pneumatically operable agitators are mounted on the walls to prevent bridging of the space between the wall ends of the material during removal thereof.

8 Claims, 5 Drawing Sheets

PNEUMATIC GATE FOR RAILWAY HOPPER CARS

This invention relates to gates provided on railway cars and other vehicles for the discharge of particulate materials from the vehicle.

BACKGROUND OF THE INVENTION

It is well known in the art to provide, at the bottom of railway cars which carry particulate materials, pairs of sloping surfaces which face each other and which are spaced apart at their lower ends for the discharge of the material between such ends. The space between the ends is blocked or unblocked by one or more manually operable valves which are opened for the discharge of the material.

It is also known in the art to provide a trough below the valves for receiving the material from which trough the material is removed through a hose or pipe connected to a vacuum system.

One successful prior art gate structure is disclosed in U.S. Pat. No. 4,500,230 and comprises a pair of downwardly converging walls separated at their lower ends. The space between the ends, in one embodiment, is occupied by two end-to-end, independently rotatable valves which have an arcuate outer surface and an inner surface which is differently shaped so that each valve increases in cross-sectional dimension from one circumferential side to a maximum intermediate cross-sectional dimension and then decreases to a smaller cross sectional dimension at the circumferentially opposite side. There is a trough below the valves for receiving the particulate material discharged past an open valve, and there is a capped discharge tube at each end of the trough to which a vacuum hose can be connected after it is uncapped, for removing the material from the trough.

Each of the valves shown in said U.S. Pat. No. 4,500,230 can be operated from only one side of the car, and the discharge tube cap is held in place by a bail. The bail retainer has been found to be unsatisfactory, and it has been found to be desirable to independently operate both valves from one side of a car. In addition, the trough structure and the attachment of the trough to the slope sheets are relatively complicated.

Said U.S. Pat. No. 4,500,230 also mentions the problem of bridging of the gap between the lower ends of the slope sheets by material being discharged or unloaded. While the gate structure of such patent has been found to be satisfactory for discharging relatively free-flowing, larger particles, bridging of the material and blocking of the discharge flow has been encountered with smaller particles such as particles of corn starch or flour. When such bridging occurs, the bridging material must be dislodged manually causing extra expense and delay in unloading a car.

BRIEF SUMMARY OF THE INVENTION

It is an object of the invention to eliminate the bridging problems encountered with materials having a very small particle size and to do so even when the valves are provided with controls which permit either valve to be operated from either side of a car.

It is a further object of the invention to provide an improved mechanism for retaining and removing the cap which is applied over the trough discharge tube.

It is a further object of the invention to provide a simplified trough construction which is simple to assemble with the slope sheets.

In accordance with the preferred embodiment of the invention, air discharging devices are mounted on the walls forming part of the gate unit so as to agitate the material as it is being discharged and in advance of the point where it enters the gap between the lower edges of the walls. The valves have controls which permit both valves to be individually operated from one side of the car, and the air discharging devices and the controls are mounted so that one does not interfere with the other.

In addition, in the preferred embodiment, the cap which covers the trough discharge tube when the car is in transit, is held in place by a lever which is pivotable in a horizontal plane and which aids in removing the cap when it is desired to discharge material from the car.

DETAILED DESCRIPTION OF THE INVENTION

While the principles of the invention have application to other gate structures, the gate structure described and illustrated in said U.S. Pat. No. 4,500,230 has advantages over the prior art, and the invention will be described with respect to the modifications thereof required to provide the gate structure of the invention.

Figure 1:
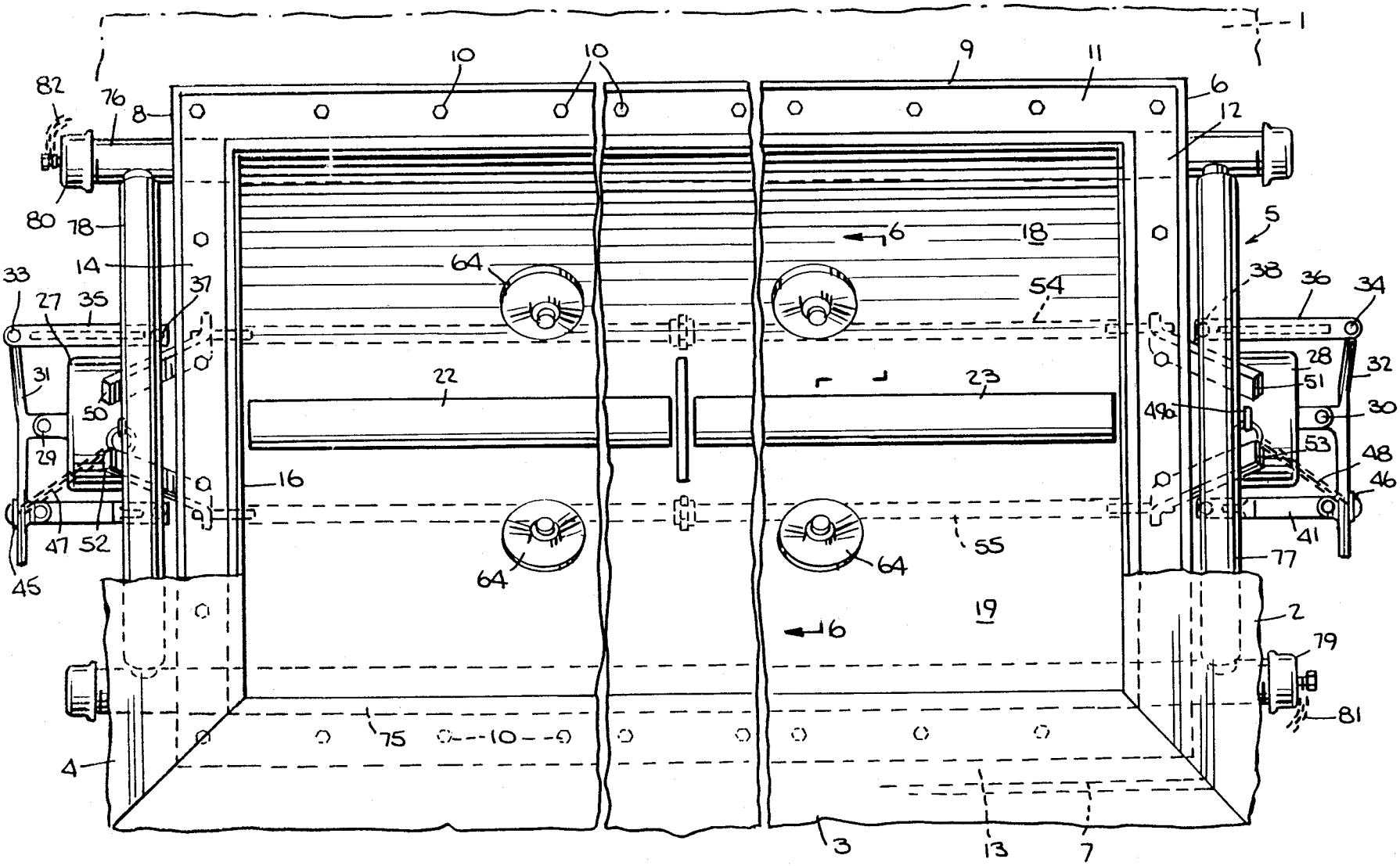
FIG. 1 is a plan view, with some parts, partly broken away, of the preferred embodiment of the invention in association with the hopper of a railway car.
Figure 2:
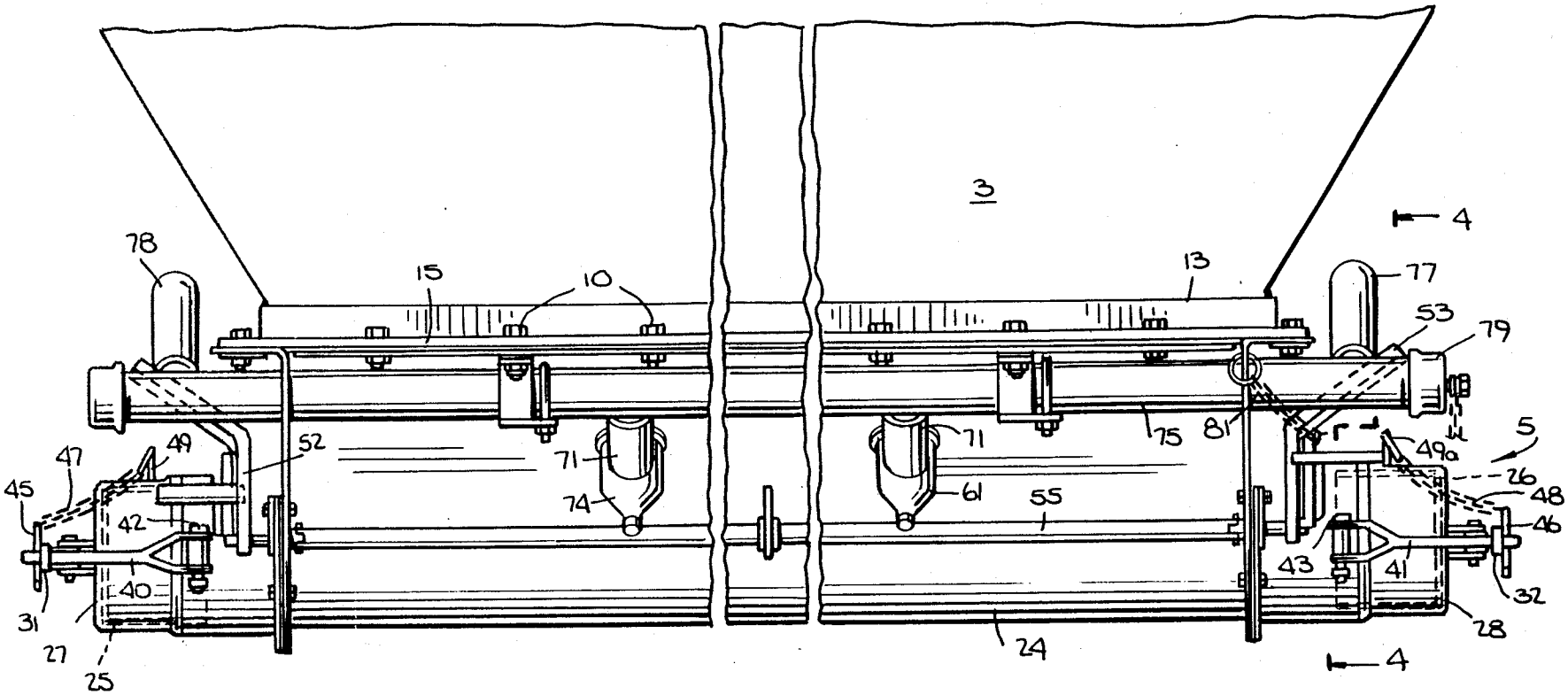
FIGS. 2 and 3 are, respectively, elevation and end views of the embodiment shown in FIG. 1.
Figure 3:
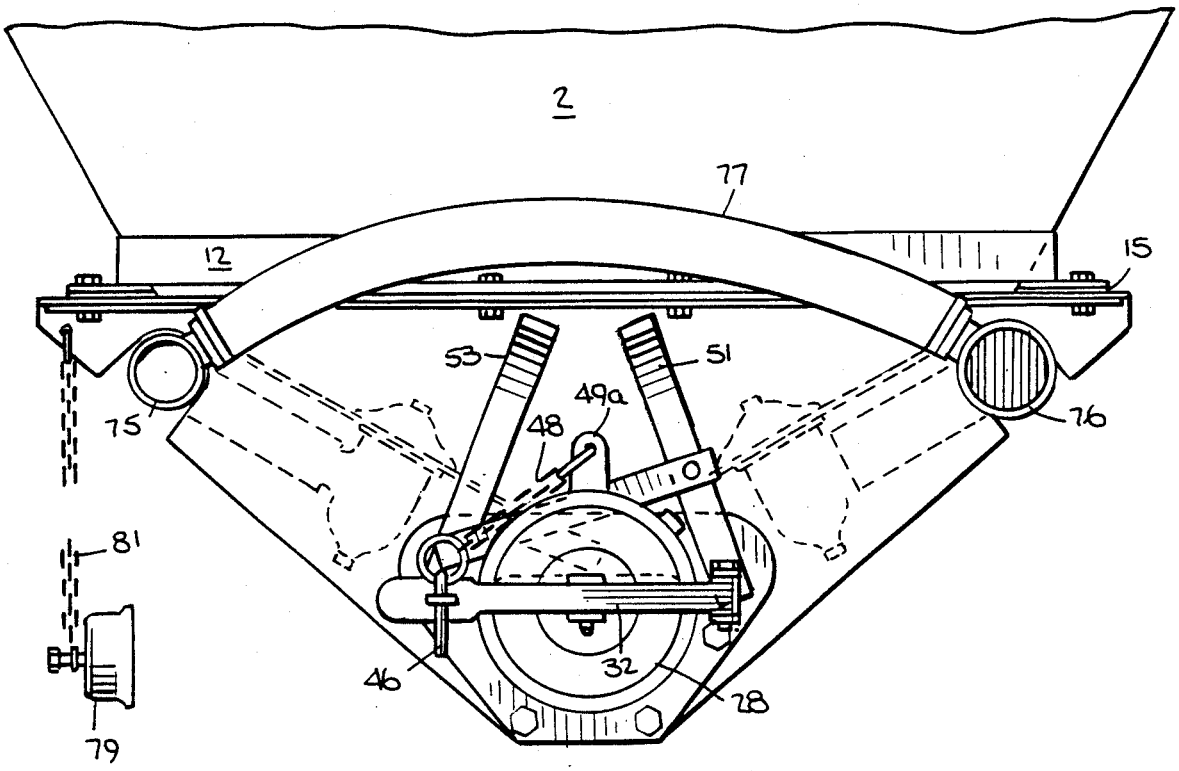

With reference to FIGS. 1 and 2, the reference numerals 1–4 designate the slope sheets of the discharge hopper of a conventional railway car so equipped. The hopper discharge structure 5 of the invention has flanges 6–9 by which it is secured by means of bolts 10 to angle irons 11–14 secured to the hopper slope plates 1–4, such as by welding. Preferably, a gasket 15 (see FIG. 2) is between the flanges 6–9 and the angle irons 11–14.

The hopper discharge structure 5 has a pair of vertical end walls 16 and 17 and a pair of inclined or sloping side walls, or slope sheets, 18 and 19, the confronting lower edges of which, 20 and 21 (see FIG. 6), are spaced apart to provide a discharge opening therebetween.

A rotatable valve, having two independently rotatable sections 22 and 23 and of the type described in said U.S. Pat. No. 4,500,230 are disposed between the lower edges 20 and 21 of the side walls 18 and 19. Both of the sections 22 and 23 have an axis of rotation extending along a line parallel to the discharge opening between the edges 20 and 21, and each of the sections 22 and 23 has a peripheral extent such that in one rotational position thereof, the discharge opening adjacent thereto is closed and in another rotational position thereof, the discharge opening adjacent thereto is open to permit particulate material to pass therethrough. As described hereinafter, each of said sections 22 and 23 is rotatable from either side of the railway car.

Figure 5:
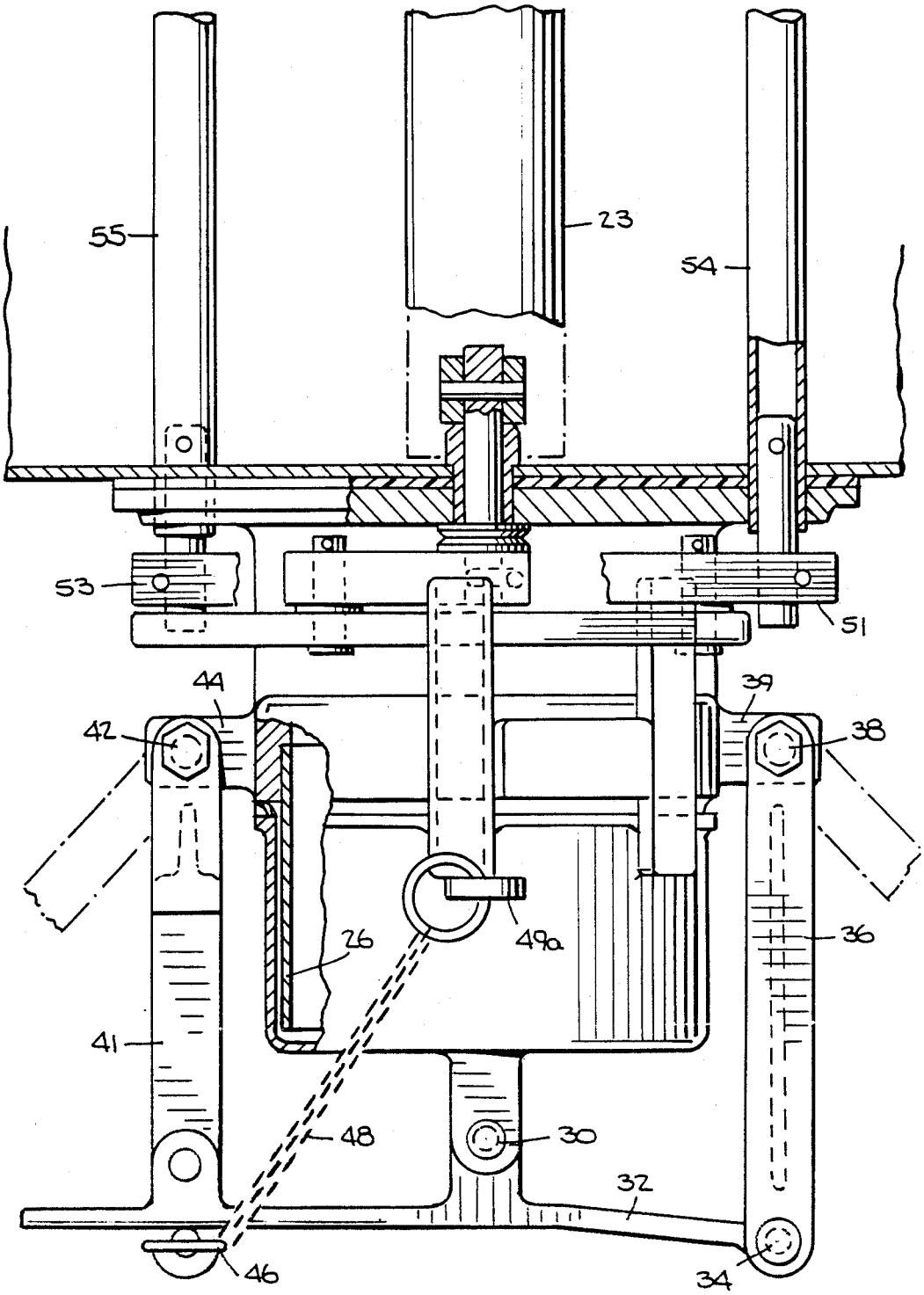
FIG. 5 is an enlarged, fragmentary, plan view partly in section of the end portion of the apparatus shown in FIG. 3.

Particulate material passing through the discharge opening is received in a trough 24 (see FIGS. 2 and 6) underlying the valve sections 22 and 23, and the particulate material is removable from said trough 24 through either or both of the discharge ports 25 and 26 (see FIGS. 2 and 5) disposed at opposite ends of the trough 24, such as by means of a vacuum system connected to a port by a hose.

Each port 25 and 26 is covered by a cap 27 and 28 when the particulate material is not being removed from the trough 24, e.g. when the railway car is being loaded with the particulate material and when the car is in transit. Each cap 27 and 28 is pivotally secured at 29 and 30 to a locking arm 31 and 32 pivotally secured at one end, 33 and 34, to one end of a pivot arm, 35 and 36, which is pivotally connected at 37 and 38 (see FIG. 5) to a bracket, such as the bracket 39, mounted on an extension of the trough 24.

A forked side link, 40 and'41, has its forked end pivotally connected at 42 and 43 to a bracket, such as the bracket 44, mounted on the extension of the trough 24. The locking arms 31 and 32 have slots through which the opposite ends of the side links 40 and 41 extend, and such opposite ends have holes therethrough for receiving detent ring pins 45 and 46 for preventing removal of the respective caps 27 and 28. To prevent loss of the pins 45 and 46, they are secured by chains 47 and 48 to brackets 49 and 50 on the caps 27 and 28.

To remove a cap, 27 or 28, the pin 45 or 46 associated therewith is removed and then, the locking arm 31 or 32, is moved away from the trough 24 causing the cap associated therewith to be removed from the associated port 25 or 26.

Either valve section, 22 or 23, may be opened or closed from either side of a car by means of operating levers 50–53 (see FIGS. 1–4). Operating lever 51 is secured to a pivotable shaft 54 so as to pivot therewith. As seen in FIG. 1, the shaft 54 extends from the lever 51 to the lever 50 which is also secured to the shaft 54 so that by movement of the lever 50 the shaft 54 is rotated. The operating levers 52 and 53 are similarly connected to a shaft 55.

Figure 4:
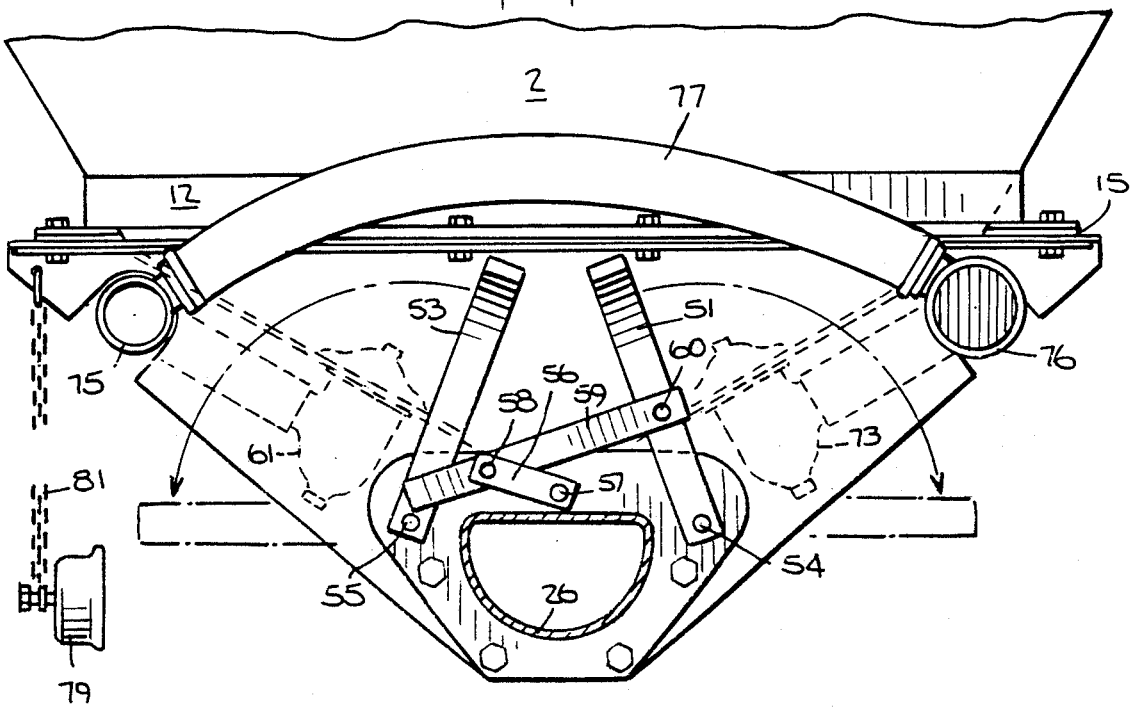
FIG. 4 is similar to FIG. 3 but is partly in section.

The linkages connecting the operating levers 50–53 to the valve sections 22 and 23 are the same at both ends of the trough 24, and therefore, the linkages at only one end of the trough 24 will be described in connection with FIG. 4. As shown in FIG. 4, an arm 56 is secured to the shaft 57 which rotates the valve section 23 so that when the arm 56 pivots, the shaft 57 rotates. The arm 56 is pivotally connected at 58 to a link 59 which is pivotally connected at 60 to the operating lever 51. Thus, when either the operating lever 51 at one side of the car is pivoted or the operating lever 50 at the opposite side of the car is pivoted, the valve section 23 is rotated, in an obvious manner, from opened to closed and vice versa.

Similarly, when either the operating lever 52 at one side of the car is pivoted or the operating lever 53 at the opposite side the car is pivoted, the valve section 22 is rotated, in an obvious manner, from opened to closed and vice versa.

As mentioned hereinbefore, the hopper discharge structure described hereinbefore has been found to be satisfactory for discharging relatively free-flowing, larger particles. However, with particulate material of smaller particle size, such as corn starch or flour, difficulties have been encountered in that bridging or caking occurs at the discharge opening between the edges 20 and 21 of the slope sheets 18 and 19 which interrupts or reduces the flow of the particulate material through the discharge opening and which has required manual dislodging of the bridges or cakes.

It has been found that by agitating the particulate material adjacent to the discharge opening with air at a pressure above atmospheric pressure during the discharge of the particulate material through the discharge opening, such bridging and caking of the material can be avoided. While the air can be directed toward the particulate material by various means, it has been found that it is preferable to direct the air into the underside of the material through openings in the slope sheets 18 and 19 of the hopper discharge structure adjacent to the discharge opening. However, there are space limitations with the hopper discharge structure described hereinbefore because of the locations of the shafts 54 and 55, the port caps 27 and 28 and the operating levers 50–53, which cause problems in devising means for supplying such air to the openings in the slope sheets 18 and 19.

It has been found that a device on the market which is sold as a Solimar Clear View Air-Aider has a relatively small size and agitates material both by means of flowing air and by mechanical means. Preferably, there are two such devices for each valve section 22 and 23 disposed on opposite sides of the axis thereof.

Figure 6:
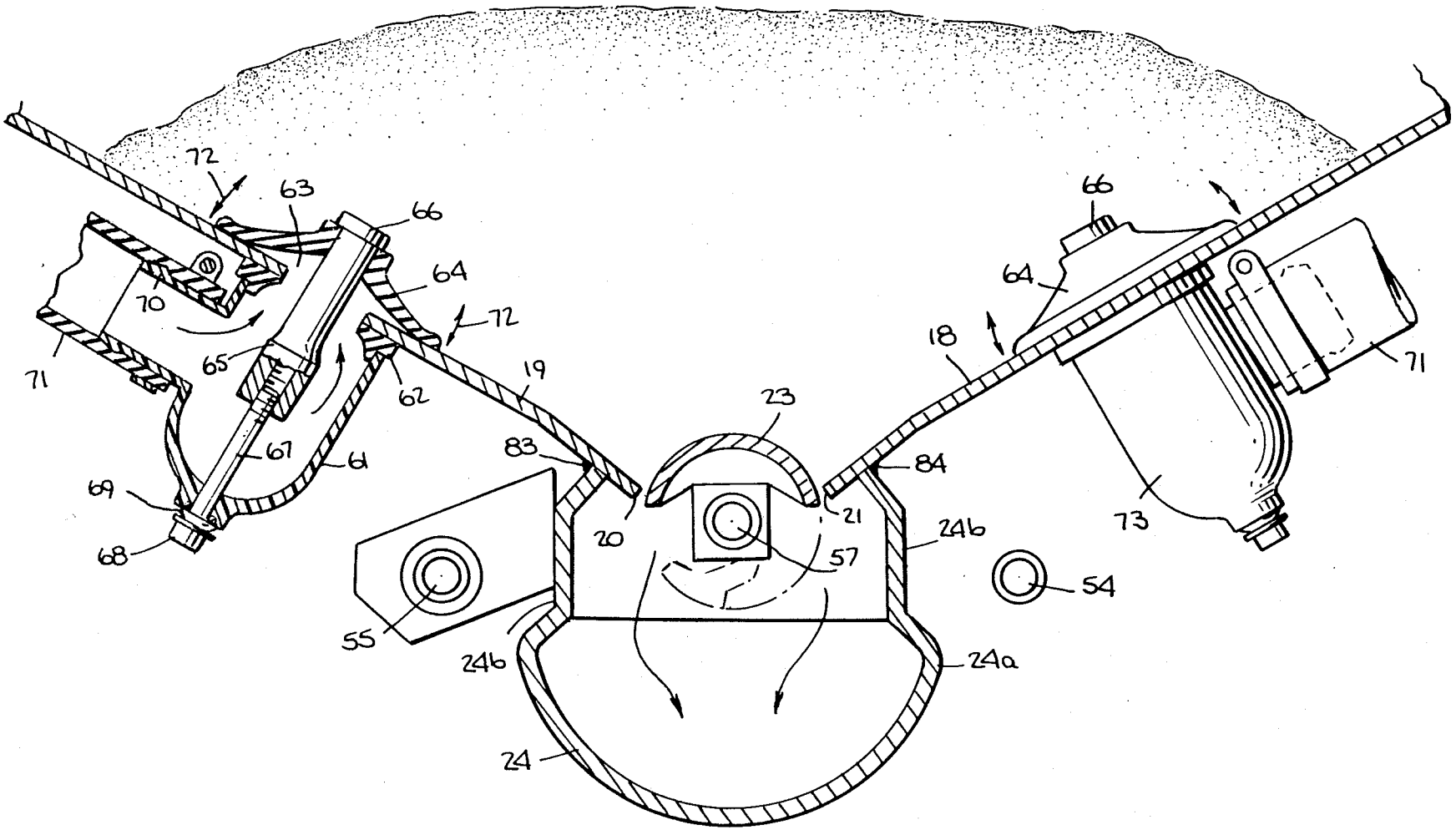
FIG. 6 is an enlarged, partial cross-section of the preferred embodiment and is taken along the line 6—6 shown in FIG. 1.

One of said agitating devices is shown in cross-section in FIG. 6 and comprises a manifold 61, which may be made of a clear plastic or of another material, held against a gasket 62 bearing against the exterior surface of the slope sheet 19 and extending around an opening 63 through the slope sheets 19. A flexible pad 64, e.g. a concave disc of rubber, bears against the interior surface of the slope sheet 19 and is held in place by a stem 65 which has an enlarged head 66 and which passes through the pad 64. At its opposite end, the stem 65 is internally threaded and receives a rotatable threaded bolt 67. The head 68 of the bolt 67 bears against a spring washer 69 which bears against the manifold 61. The manifold 61 has an air inlet extension 70 to which air under a pressure above atmospheric pressure, e.g. 15–20 psig is supplied through a hose 71.

The bolt 67 is adjusted so that the pad 64 presses against the inner surface of the shope sheet 19 with sufficient pressure to prevent particles from flowing through the opening 63 and to hold the manifold 61 against the gasket 62 and the gasket 62 against the exterior surface of the slope sheet 19 when no air under pressure is supplied to the manifold 61 but with a pressure low enough so that when air under pressure is supplied to the manifold 61, the outer edge portion of the pad 64 will lift, permitting air to flow into the lading on top of the pad 64 and causing the outer edge portion to flutter as indicated by the arrows 72. Thus, the lading is agitated both by the air passing between the edge portion of the pad 64 and the interior surface of the slope sheet 19 and by the mechanical movement of the edge portion.

Preferably, there are four such agitating devices, the manifolds 61, 73 and 74 being shown in FIGS. 2 and 6 and the pads 64 of the four devices being shown in FIG. 1. The centerline of each device is spaced from the axis of the associated valve section, 22 or 23, by an amount sufficient to permit the manifolds thereof to clear the shafts 54 and 55, e.g. depending on the locations of the shafts 54 and 55, on the order of nine inches, and is on a line perpendicular to the axis of the associated valve section which is about mid-way between the ends of the valve section.

The four agitating devices are supplied with air under pressure through supply manifolds 75 and 76 (see particularly FIGS. 3 and 4) which are interconnected near their ends by pipes or hoses 77 and 78. So that air may be supplied to the manifolds 75 and 76 at either side of the car from any conventional source thereof, each manifold is provided at one end with a removable cap, 79 and 80, which, after removal, is retained by chains 81 and 82.

The trough 24 usually is an extrusion, e.g. of aluminum, and the troughs of said U.S. Pat. No. 4,500,230 are either relatively large or require relatively complicated extrusion dies. In the preferred embodiment of the invention, the trough 24 is relatively simple and does not require complicated extrusion dies. With reference to FIG. 6, the cross-section of the trough 24 does not have any recesses or indentations for receiving gaskets, which have been found to be unnecessary, and does not have any extensions for securing it to the slope sheets 18 and 19. Instead, the ends of the trough 24 are secured to the slope sheets 18 and 19, such as by welding at 83 and 84, and to increase the capacity of the trough 24, it is wider at its lower portion **24*a* than the spacing between the upper walls 24*b* which are secured to the slope sheets 18 and 19**.

Although preferred embodiments of the present invention have been described and illustrated, it will be apparent to those skilled in the art that various modifications may be made without departing from the principles of the invention.

We claim:

1. In a hopper discharge structure having a discharging valve for evacuating particulate material from hopper cars and the like comprising:

(a) a hopper having end walls and inclined side walls, the confronting lower edges of said side walls being spaced apart to provide a discharge opening therebetween;

(b) a rotatable valve having its axis of rotation extending along a line parallel to said discharge opening, said valve having a peripheral surface which in one rotational position thereof closes said opening and which in another rotational position thereof permits particulate material to pass through said opening; and (c) a trough underlying said valve for receiving particles discharged through said opening, said trough having a discharge port at at least one end thereof through which particles in said trough can be withdrawn;

the improvement comprising particle agitating means mounted on at least one of said side walls in spaced relation to said discharge opening, said one side wall having a side wall opening therethrough adjacent, but spaced from said discharge opening and extending from the exterior to the interior of said one side wall and said particle agitating means comprising a flexible pad interiorly of said hopper and covering said side wall opening, said pad normally engaging the interior surface of said one side wall, and means for supplying air under a pressure above atmospheric pressure to said side wall opening at the exterior of said one side wall, said pad being movable, at least in part, away from said interior surface by said air under pressure to permit said air under pressure to enter said hopper and hence, into contact with the particles in said hopper.

2. A hopper discharge structure as set forth in claim 1 wherein said pad is resiliently pressed against said interior surface.

3. A hopper discharge structure as set forth in claim 1 wherein there are two separately rotatable valves in axial alignment, one of said valves having a peripheral surface which in one rotational position thereof closes a first portion of said discharge opening and which in another rotational position thereof, permits particulate material to pass through said first portion of said discharge opening and the other of said valves having a peripheral surface which in one rotational position thereof, closes the remainder of said discharge opening and which in another rotational position thereof permits particulate material to pass through said remainder of said discharge opening and wherein there are four particle agitating means, two of said particle agitating means being mounted on said side walls at openings therethrough at respectively opposite sides of said one of said valves intermediate the axial length of said one of said valves and two of said agitating means being mounted on said side walls at openings therethrough at respectively opposite sides of said other of said valves intermediate the axial length of said other of said valves, each of said particle agitating means being spaced laterally from said discharge opening.

4. A hopper discharge structure as set forth in claim 1 further comprising a cap for said port, said cap being pivotally mounted on a locking member movable toward and away from said port and said locking member being pivotally mounted at one end to one end of a first link which is pivotally mounted at its opposite end from said hopper and being engageable at its opposite end with and disengageable from one end of a second link which is pivotally mounted at its opposite end from said hopper.

5. A hopper discharge structure as set forth in claim 4 wherein said locking member has an opening therein at its opposite end for receiving said one end of said second link and said second link extends substantially parallel to said first link and has an opening at said one end thereof and further comprising a hand removable locking pin receivable in said opening at said one end of said second link and engageable with said locking member for preventing pivoting of said locking member and hence, removal of said cap from said port.

6. A hopper discharge structure as set forth in claim 1 wherein the other of said side walls has a side wall opening therethrough adjacent, but spaced from said discharge opening and extending from the exterior to the interior of said one side wall and comprising another of said particle agitating means, said other of said particle agitating means being mounted on the other of said side walls with the flexible pad thereof interiorly of said hopper and covering said side wall opening in said other side wall, said pad normally engaging the interior surface of said other side wall and means for supplying air under a pressure above atmospheric pressure to said side wall opening in said other side wall.

7. A hopper discharge structure as set forth in claim 1 wherein said trough, in cross-section, has a pair of spaced, vertical side walls with their upper ends secured to said side walls of said hopper and a lower wall portion interconnecting the lower ends of said side walls of said trough, said lower wall portion having its sides spaced apart by an amount greater than the spacing between said side walls of said trough.

8. In a hopper discharge structure having a discharging valve for evacuating particulate material from hopper cars and the like comprising:

(a) a hopper having end walls and inclined side walls, the confronting lower edges of said side walls being spaced apart to provide a discharge opening therebetween;

(b) a rotatable valve having its axis of rotation extending along a line parallel to said discharge opening, said valve having a peripheral surface which in one rotational position thereof closes said opening and which in another rotational position thereof permits particulate material to pass through said opening; and (c) a trough underlying said valve for receiving particles discharged through said opening, said trough having a discharge port at at least one end thereof through which particles in said trough may be withdrawn;

the improvement comprising two particle agitating means, one of said particle agitating means being mounted on one of said side walls in spaced relation to said discharge opening and the other of said particle agitating means being mounted on the other of said side walls in spaced relation to said discharge opening and said particle agitating means comprising means for supplying air under a pressure above atmospheric pressure through said one of said side walls to the interior of said hopper and hence, into contact with the particles in said hopper, and a first air supply tube mounted at the exterior of one of said side walls, and extending in the direction from one end wall toward the other end wall, a second air supply tube at the exterior of the other of said side walls and extending in the direction from one end wall toward the other end wall, an air tube interconnecting said first air supply tube and said second air supply tube and disposed adjacent one of said end walls and means interconnecting said first air supply tube and said second air supply tube with, respectively, said one of said particle agitating means and said other of said particle agitating means for the supply of air under pressure thereto.

* * * * *